United States Patent [19]

Alloggiamento

[11] Patent Number: 4,793,634

[45] Date of Patent: Dec. 27, 1988

[54] ORIGINAL PERPETUAL DIARY CALENDAR

[76] Inventor: Paul Alloggiamento, 86-11 34th Ave., Apt. 6K, Jackson Heights, N.Y. 11372

[21] Appl. No.: 944,956

[22] Filed: Dec. 22, 1986

[51] Int. Cl.[4] ..... B42D 5/04

[52] U.S. Cl. ..... 283/2; 40/107; 434/416

[58] Field of Search ..... 283/1 A, 11 R, 2, 3, 283/4; 281/1; 40/107, 110, 119, 121, 122, 358; D19/20; 29/110; 434/416, 408, 430

[56] References Cited

U.S. PATENT DOCUMENTS

| | | | |
|---|---|---|---|
| 1,470,065 | 10/1923 | Downer | 40/107 |
| 1,601,119 | 8/1926 | Heaton | 40/107 |
| 2,626,819 | 1/1953 | Winford | 283/2 |
| 2,731,746 | 1/1956 | Newman | 283/2 |
| 2,791,040 | 5/1957 | Santorelli | 434/416 |
| 3,642,191 | 2/1972 | Roof | 434/408 |
| 4,587,568 | 5/1986 | Takayama et al. | 434/430 |

*Primary Examiner*—Paul A. Bell

*Attorney, Agent, or Firm*—Michael I. Kroll

[57] ABSTRACT

A calendar diary chart is provided and is designed to be a perpetual calendar diary of a size small enough to be used by all types of people for business, home and pleasure purposes. The calendar diary chart includes a plastic coating on its surface to be written upon on a day to day basis for one complete year.

11 Claims, 3 Drawing Sheets

ORIGINAL PERPETUAL DIARY CALENDAR

BACKGROUND OF THE INVENTION

1. Field of the Invention

The instant invention relates generally to calendar diarys and more specifically it relates to a calendar diary chart that provides a perpetual diary.

2. Description of the Prior Art

Numerous calendar diarys have been provided in prior art that are adapted to show the months, weeks and days in at least one specific year that are arbitrarily defined or otherwise established. While these units may be suitable for the particular purpose to which they address, they would not be as suitable for the purposes of the present invention as heretofore described. Prior calendars never provided a perpetual usage as well as a perpetual diary.

SUMMARY OF THE INVENTION

A primary object of the present invention is to provide a calendar diary chart that will overcome the shortcomings of the prior art devices.

Another object is to provide a calendar diary chart that is designed to be a perpetual calendar as well as a perpetual diary and of a size small enough to be used by all types of people for business, home and pleasure purposes.

An additional object is to provide a calendar diary chart that contains a plastic coating on its surface so as to be written upon day by day for one complete year.

A further object is to provide a calendar diary chart that is simple and easy to use.

A still further object is to provide a calendar diary chart that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1*a* is a front view of the left side of the invention.

DETAILED DESCRIPTION OF THE PREFERRED EMBODIMENTS

Figure 1A:
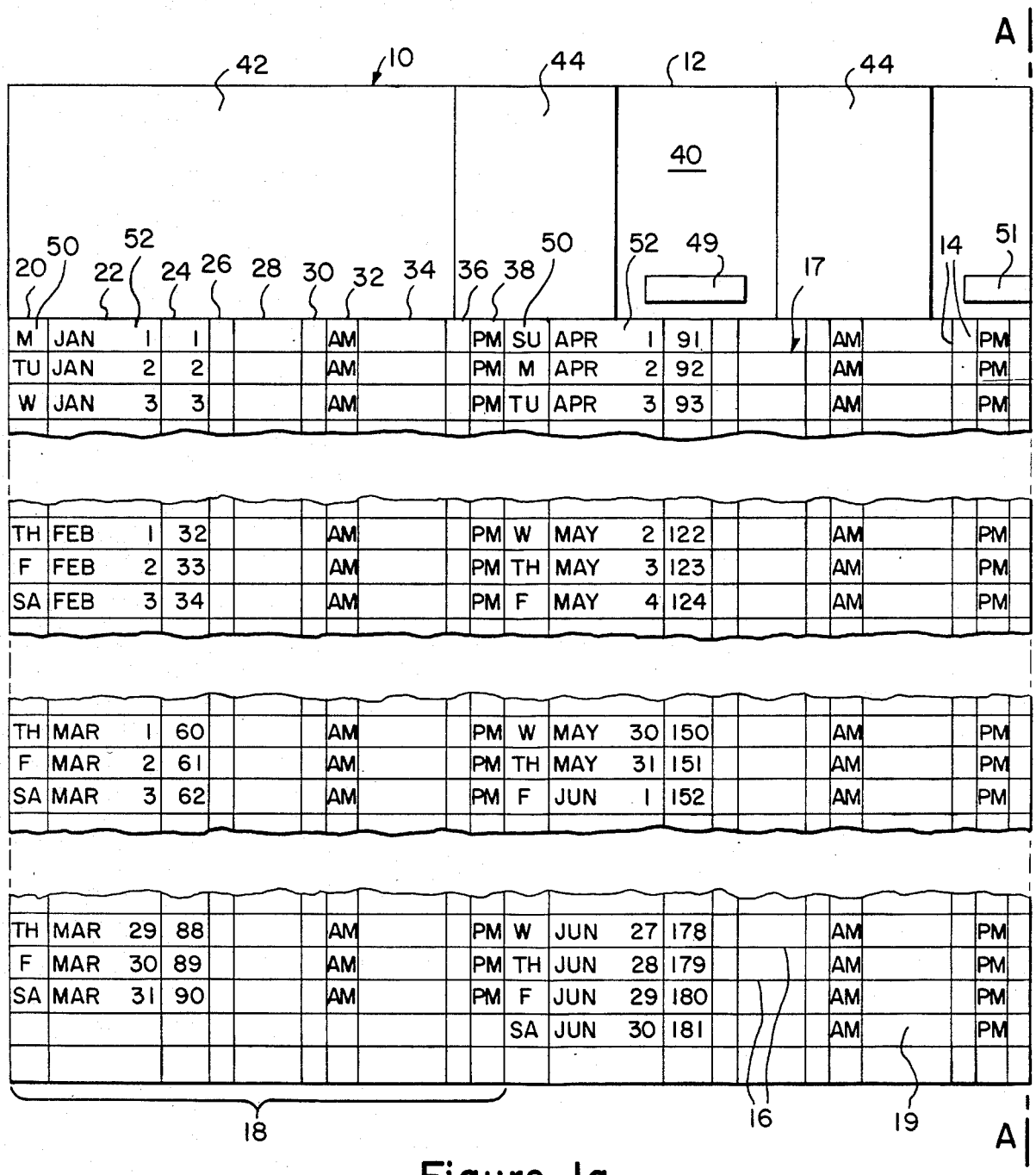
FIG. 1is a front view of the right side thereof.
Figure 1B:
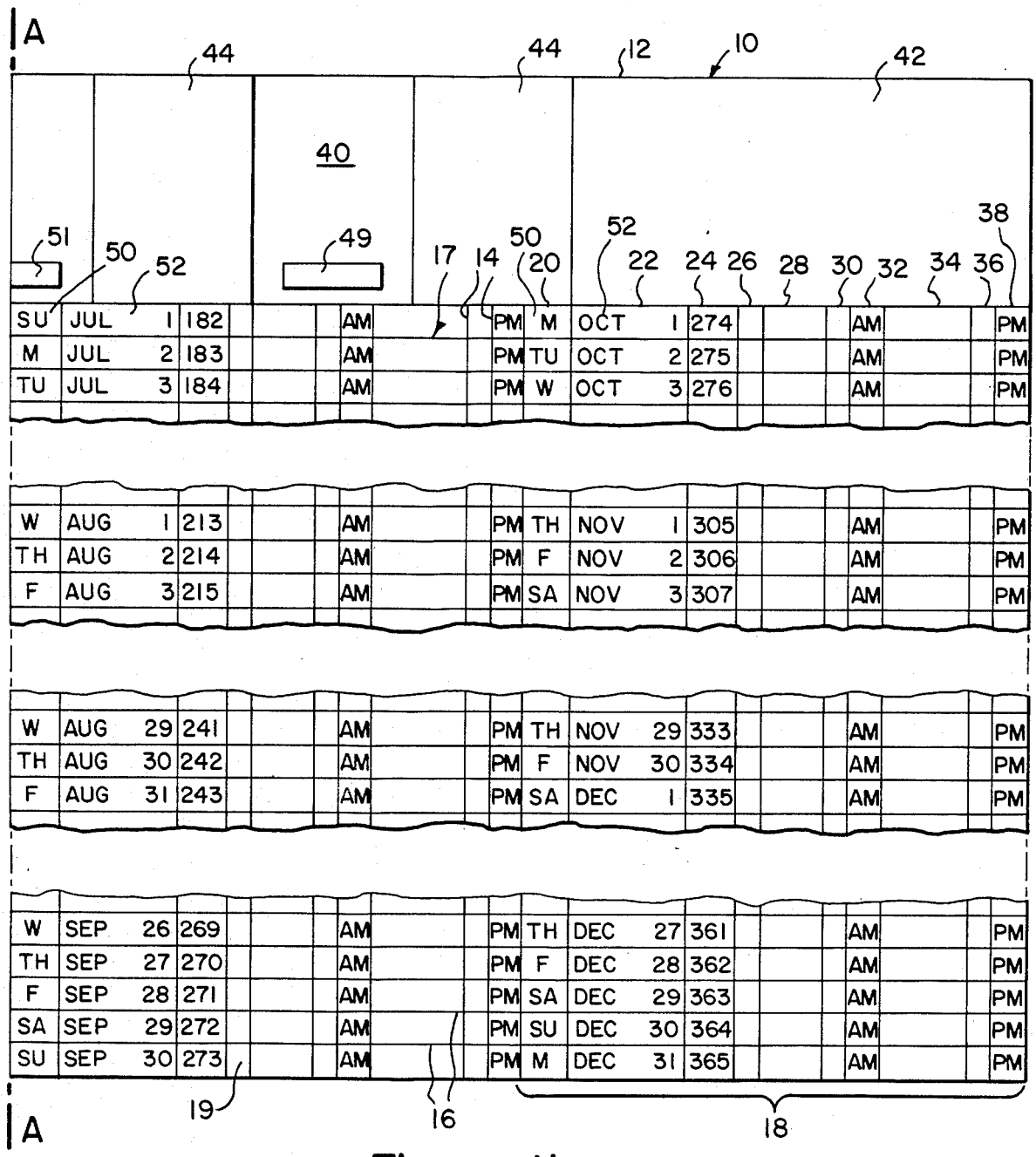

Turning now descriptively to the drawings, in which similar reference characters denote similar elements throughout the several views, FIGS. 1*a* and 1*b* illustrate a calendar diary chart 10 consisting of a flat sheet of rigid cardboard 12. A plurality of vertical lines 14 and horizontal lines 16 are disposed onto the cardboard sheet 12 forming a grid pattern 17 divided into quarterly segments 18 for one complete year. A transparent coating of plastic material 19 is on front and rear surfaces of the cardboard sheet 12 so that the grid pattern 17 can be written upon and erased for future use thus making the calendar diary chart 10 perpetual.

Each of the quarterly segments 18 of the grid pattern 17 contains a first column 20 for indicating names of days. A second column 22 is for indicating each month and days of each month. A third column 24 is for indicating the numerical day of the year. A fourth column 26 is for indicating a first set of check boxes. A fifth column 28 is for indicating a first set of note boxes. A sixth column 30 is for indicating a second set of check boxes. A seventh column 32 is for indicating AM boxes. An eighth column 34 is for indicating a second set of note boxes. A nineth column 36 is for indicating a third set of check boxes. A tenth column 38 is for indicating PM boxes.

Figure 4:
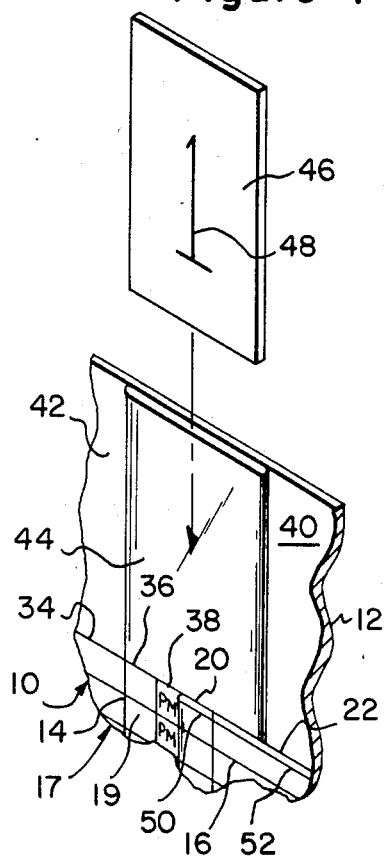
FIG. 4 is an exploded front perspective view of a portion of the chart showing a pocket therein with an insertable card to indicate one digit of the calendar year.

The cardboard sheet 12 has a heading portion 40 over the grid pattern 17. A pair of business card holders 42 are provided, each of which is disposed at each corner of the heading portion 40. Four spaced apart pockets 44 are disposed on the heading portion 40 between the business card holders 42. As best shown in FIG. 4, a plurality of cards 46 are provided, each having one number digit 48 representing the year are insertable into each of the respective pockets 44 so that the year can be displayed therefrom. The calendar chart 10 also includes two pen holders 49, each of which are disposed on the heading portion 40 between two of the year pockets 44. A magnifying glass holder 51 is provided and is also disposed on the heading portion 40 between two of the year pockets 44.

Figure 2:
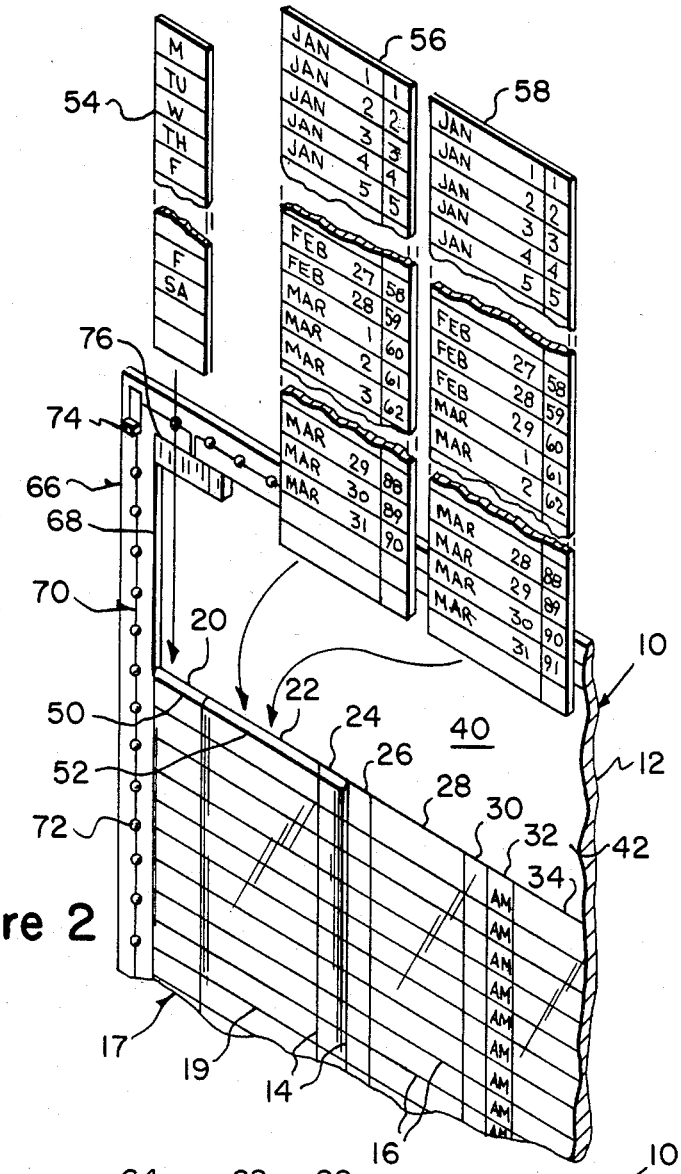
FIG. 2 is an exploded front perspective view of a portion of the chart showing pockets therein with insertable strips and a light strip border around perimeter thereof.

As best seen in FIG. 2, each of the quarterly segments 18 of the grid pattern 17 further include a first elongated pocket 50 formed in the first column 20 while second elongated pocket 52 is formed in the second and third columns 22 and 24. A first elongated strip 54 that has names of days thereon is snugly insertable at a proper position into the first pocket 50. A second elongated strip 56 that has each month, days of each month and days of a regular year thereon is snugly insertable at a proper position into the second pocket 52 for the regular year. A third elongated strip 58 that has each month, days of each month and days of a leap year thereon is snugly insertable at a proper position into the second pocket 52 for the leap year.

Figure 3:
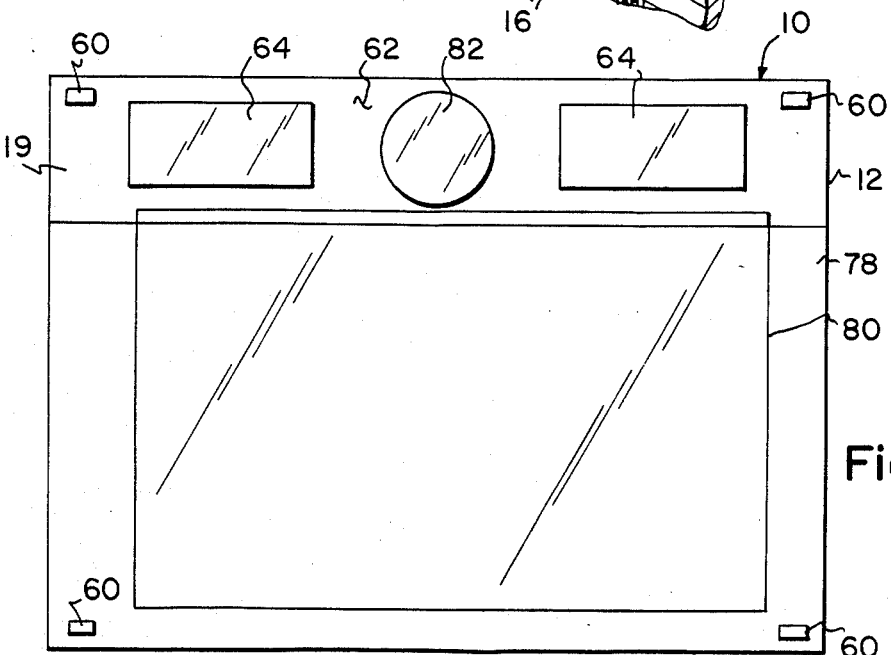
FIG. 3 is a rear view of the chart.

FIG. 3 shows a rear view of the calendar diary chart 10. A magnet tab 60 is disposed at each corner on rear surface 62 of the cardboard sheet 12 so that the calendar diary chart 10 can be secured to a magnetic flat surface (not shown). A plurality of additional business card holders 64 are also disposed on upper portion of the rear surface 62 of the cardboard sheet 12.

A large pocket 78 is disposed on lower portion of the rear surface 62 of the cardboard sheet 12 for holding various papers 80 and the like therein. A round reflective member 82 is disposed on the upper portion of the rear surface 62 of the cardboard sheet 12 to be used as a mirror.

As shown in FIG. 2 a light strip border 66 can be provided around perimeter 68 of the calendar diary chart 10. The light strip border 66 includes an electrical circuit 70 that has a plurality of small light bulbs 72, a small switch 74 and self-contained battery 76 so that the calendar diary chart 10 may be viewed during the night or in areas where there is a minimum amount of light.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A calender diary chart comprising:

(a) a flat sheet of rigid cardboard;

(b) a plurality of vertical lines and horizontal lines disposed onto said cardboard sheet forming a grid pattern divided into quarterly segments for one complete year, each of said quarterly segments of said grid pattern including a first column, a second column, a third column, a fourth column indicating a first set of check boxes, a fifth column indicating a first set of note boxes, a sixth column indicating a second set of check boxes, a seventh column indicating AM boxes, an eighth column indicating a second set of note boxes, a ninth column indicating a third set of check boxes, and a tenth column indicating PM boxes;

(c) a first elongated pocket formed in said first column;

(d) a second elongated pocket formed in said second and third columns;

(e) a first elongated strip having names of days thereon, said first strip snugly insertable at a proper position into said first pocket;

(f) a second elongated strip having each month, days of each month and days of a regular year thereon, said second strip snugly insertable at a proper position into said second pocket for the regular year; and (g) a third elongated strip having each month, days of each month and days of a leap year thereon, said third strip snugly insertable at a proper position into said second pocket for the leap year.

2. A calendar diary chart as recited in claim 5, further comprising:

(a) four magnet tabs, each of which is disposed at each corner on rear surface of said cardboard sheet so that said calendar diary chart can be secured to a magnetic flat surface; and (b) a plurality of additional business card holders disposed on upper portion of said rear surface of said cardboard sheet.

3. A calendar diary chart as recited in claim 2, further comprising a large pocket disposed on lower portion of said rear surface of said cardboard sheet for holding various papers therein.

4. A calendar diary chart as recited in claim 3, further comprising a round reflective member disposed on said upper portion of said rear surface of said cardboard sheet to be used as a mirror.

5. A calendar diary chart as recited in claim 4 further comprising a light strip border around the perimeter of said calendar diary chart and including an electrical circuit having a plurality of light bulbs, a switch and a self-contained battery so that said calendar diary chart may be viewed during the night and in areas where there is a minimum amount of light.

6. A calendar diary chart as recited in claim 5, further comprising:

(a) said cardboard sheet having a heading portion over said grid pattern, (b) a pair of business card holders, each of which is disposed at each corner of said heading portion;

(c) four spaced apart pockets disposed on said heading portion between said business card holders; and (d) a plurality of cards each having one number digit representing the year and insertable into each of said respective pockets that the year can be displayed therefrom.

7. A calendar diary chart as recited in claim 6, further comprising:

(a) two pen holders, each of which are disposed on said heading portion between two of said year pockets; and (b) a magnifying glass holder disposed on said heading portion between two of said year pockets.

8. A calendar diary chart as recited in claim 7, further comprising:

(a) four magnet tabs, each of which is disposed at each corner on rear surface of said cardboard sheet so that said calendar diary chart can be secured to a magnetic flat surface; and (b) a plurality of additional business card holders disposed on upper portion of said rear surface of said cardboard sheet.

9. A calendar diary chart as recited in claim 8, further comprising a large pocket disposed on lower portion of said rear surface of said cardboard sheet for holding various papers therein.

10. A calendar diary chart as recited in claim 9, further comprising a round reflective member disposed on said upper portion of said rear surface of said cardboard sheet to be used as a mirror.

11. A calendar diary chart as recited in claim 10, further comprising a light strip border around the perimeter of said calender diary chart and including an electrical circuit having a plurality of light bulbs, a switch and a self-contained battery so that said calendar diary chart may be viewed during the night and in area where there is a minimum amount of light.

* * * * *